US009598899B2

(12) United States Patent
Spanjaard

(10) Patent No.: US 9,598,899 B2
(45) Date of Patent: Mar. 21, 2017

(54) VERTICAL AND HORIZONTAL BLINDS WITH LIGHTING

(76) Inventor: Roeland Jan Spanjaard, Cadier & Keer (NL)

( * ) Notice: Subject to any disclaimer, the term of this patent is extended or adjusted under 35 U.S.C. 154(b) by 1975 days.

(21) Appl. No.: 12/597,935

(22) PCT Filed: Apr. 30, 2008

(86) PCT No.: PCT/NL2008/000121

§ 371 (c)(1),
(2), (4) Date: Apr. 19, 2010

(87) PCT Pub. No.: WO2008/133500

PCT Pub. Date: Nov. 6, 2008

(65) Prior Publication Data

US 2012/0057346 A1 Mar. 8, 2012

(30) Foreign Application Priority Data

May 1, 2007 (NL) ..... 1033785

(51) Int. Cl.

| | |
|---|---|
| ***F21V 17/02*** | (2006.01) |
| ***E06B 9/386*** | (2006.01) |
| ***G09F 11/02*** | (2006.01) |
| *E06B 9/24* | (2006.01) |

(52) U.S. Cl.
CPC ..... *E06B 9/386* (2013.01); *G09F 11/025* (2013.01); *E06B 2009/247* (2013.01)

(58) Field of Classification Search
CPC ... E06B 9/386; E06B 2009/247; G09F 11/025
USPC ..... 362/290, 321, 325, 351–352, 354–357
See application file for complete search history.

(56) References Cited

U.S. PATENT DOCUMENTS

| | | | | |
|---|---|---|---|---|
| 5,975,725 | A * | 11/1999 | Ireland-Stacy | 362/357 |
| 2005/0237741 | A1* | 10/2005 | Chang | 362/249 |
| 2005/0269044 | A1* | 12/2005 | Nien | 160/236 |

* cited by examiner

*Primary Examiner* — Jason Moon Han
(74) *Attorney, Agent, or Firm* — Guy Levi; The IP Law Firm of Guy Levi, LLC

(57) ABSTRACT

The invention is based on a certain number of hollow translucent vertical blinds (1), which are somewhat ovally profiled, wherein LED-lights or another light source (3) has been fixed and on top and bottom of the vertical blinds are bolted by a lock-cap, provided with a light source (3), or LED lights, where of both light sources independently from each other can be linked, so that special light effects can be realized in the hollow translucent vertical blinds and bolted lock caps into the top and bottom of the vertical blinds.

5 Claims, 3 Drawing Sheets

VERTICAL AND HORIZONTAL BLINDS WITH LIGHTING

CROSS REFERENCE TO RELATED APPLICATIONS

This patent application is a U.S. National Phase filing of co-pending, commonly owned PCT Application No. PCT/NL2008/000121, filed Apr. 30, 2008, which claims priority from Netherlands Patent Application No. 1033785, filed 1 May 2007 both which are hereby incorporated by reference in their entirety.

The invention is based on a certain number of hollow translucent vertical blinds, which are somewhat ovally profiled, wherein LED-lights or another light source has been fixed and on top and bottom of the vertical blinds are bolted by a lock-cap, provided with a light source or LED lights, where of both light sources independently from each other can be linked, so that special light effects can be realised in the hollow translucent vertical blinds and bolted lock caps into the top and bottom of the vertical blinds.

Current vertical and horizontal blinds consist of singular thin plate material. In case an image is fixed on the surface or is put against the closed structure of the blinds, can this be only realized by paintbrush or serigraphy. Besides, these blinds aren't utilizable for lighting, light sources cannot be assembled into singular thin plate material.

From the European Patent-Book EP 0 569 326 have been confessed, that hollow blinds exist. They are prism-moulded and inside constructed with an oblong light source but without the possibility to create special light effects.

Vertical blinds, like this invention, try to annul this disadvantage, by using light sources which exist of an amount of LED-lights or has been based on another light-technique, assembled into the hollow vertical blinds.

It prefers also to provide the transparent vertical blind with one or two interchangeable printed sheets with images from the inside, while preferably every vertical blind on top and bottom is bolted by a lock-cap, supplied with a light source of LED lights.

Also it has the preference, that the light sources in every vertical and in every lock cap can be linked independently of each other.

It is also preferred that every vertical has been made, of massive light conducted material and on top and bottom bolted with a lock cap, wherein a light source is fixed.

Preferably the hollow light-permeable blinds of hollow, equilateral triangle consist of a rotatable light core.

The invention will be explained according to the following figures.

Figure 1:
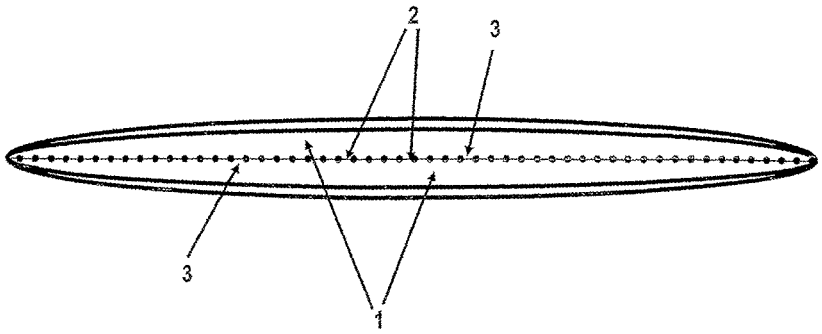
FIG. 1 shows the cross-section of a hollow vertical.
Figure 2A:
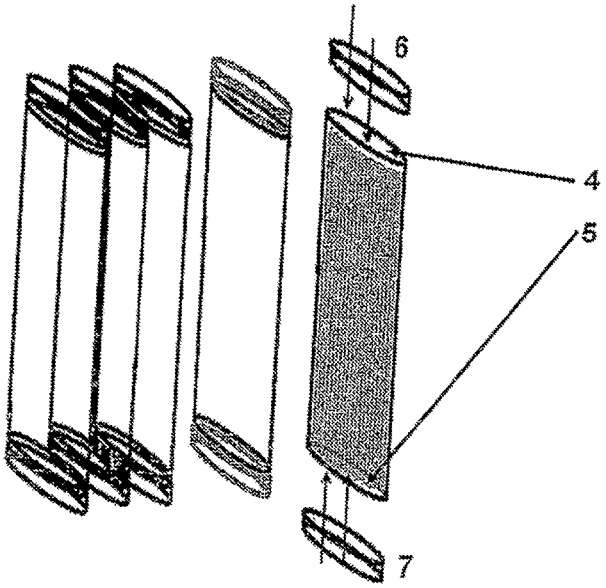
FIG. 2A shows lock caps from top and bottom side of the vertical with bottom lock cap shown in FIG. 2B.

The vertical, in accordance with the invention, consists of a long, hollow somewhat ovally profiled vertical 1, that has been made of light translucent material. The hollow vertical 1 consists of a mantle of poly(methylmethacrylate) (PMMA), glass or another light translucent material at least with the same optical qualities. Across the whole length, inside the vertical 1, a partition 2 has been constructed, that on both sides is provided with a light source 3. Every light source 3 consists of a certain light source or an amount of LED—lights. For obtaining the most optimum impact, the partition 2 has been carried out in a non-transparent or not light permeable material. This is shown in FIG. 1. The number of LEDS or another light source fixed on the partition 2, dependent of the length of the vertical 1, as light-intensity and/or color. At the top 4 and bottom 5 of the vertical 1, the hollow vertical 1 has been bolted with a lock-caps 6 and 7. As shown in FIG. 2A.

Figure 2B:
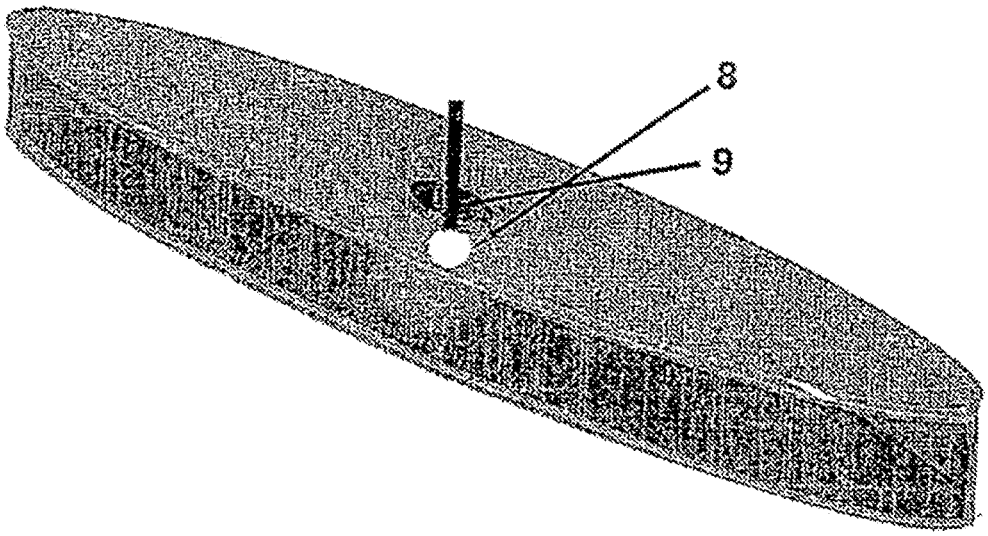

As shown in FIG. 2B, the second design of the vertical has a lock-cap 6 on top 4, and a lock-cap 7 in the bottom 5, supplied with a light source 8 & 9, consisting of LEDS, been applied in translucent or in opaque material. The wiring consists of voltage supply for a light source 3, and voltage supply for LEDS 8 and 9 of the lock-caps 6 and 7, so that all the light sources are independent and separately linked from each other.

The hollow oval-shaped verticals 1 have a front side and back side, whereof every side can be provided with an individual pattern, image and/or texture, that complements the design. According the application, the images can be eventually shown like a whole picture, because side by side these verticals 1 form a tightly closed front.

It's possible to fix an image permanently on these hollow transparent verticals 1 or printed images like interchangeable sheets, that can be slid out of the inside of the hollow verticals 1 or, interchangeable sheets on the outside.

With hollow and transparent vertical blinds 1 the possibility exists to fix or to carry out the image permanently as interchangeable foils or sheets, which can be slid into the inside of hollow verticals 1 or to the outside.

Figure 3:
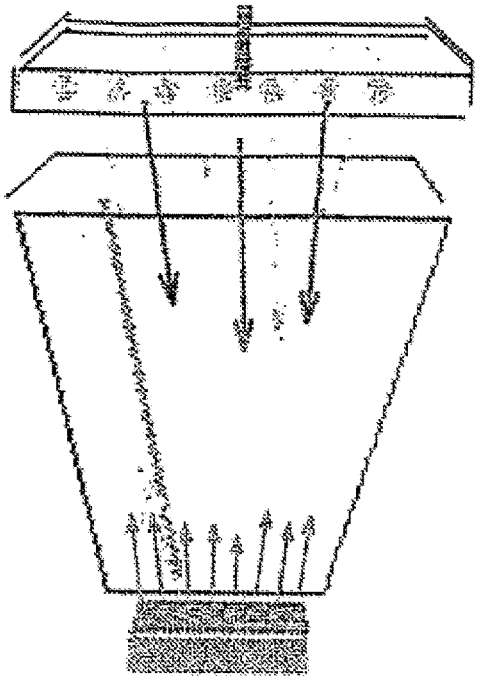
FIG. 3 shows a vertical designed in massive, light conductible material.

A third implementation of the invention, as shown in FIG. 3, is related on a composition of a number narrow, long, rectangular vertical blinds or plates of a certain thickness, that has been made of massive, light permeable and light-conductive material, such as for example massive glass or acryl glass/Plexiglas, whereat is used, the light conductive properties of the massive material.

The top and bottom side of every vertical 1 has been provided with lock caps 6 and 7, either, made of light-permeable or non transparent material and a light source 8 and 9 that illuminates in conductive manner, through all the massive, light-permeable, light-conductive verticals 1, whereby every vertical 1 diffuses light.

Figure 4:
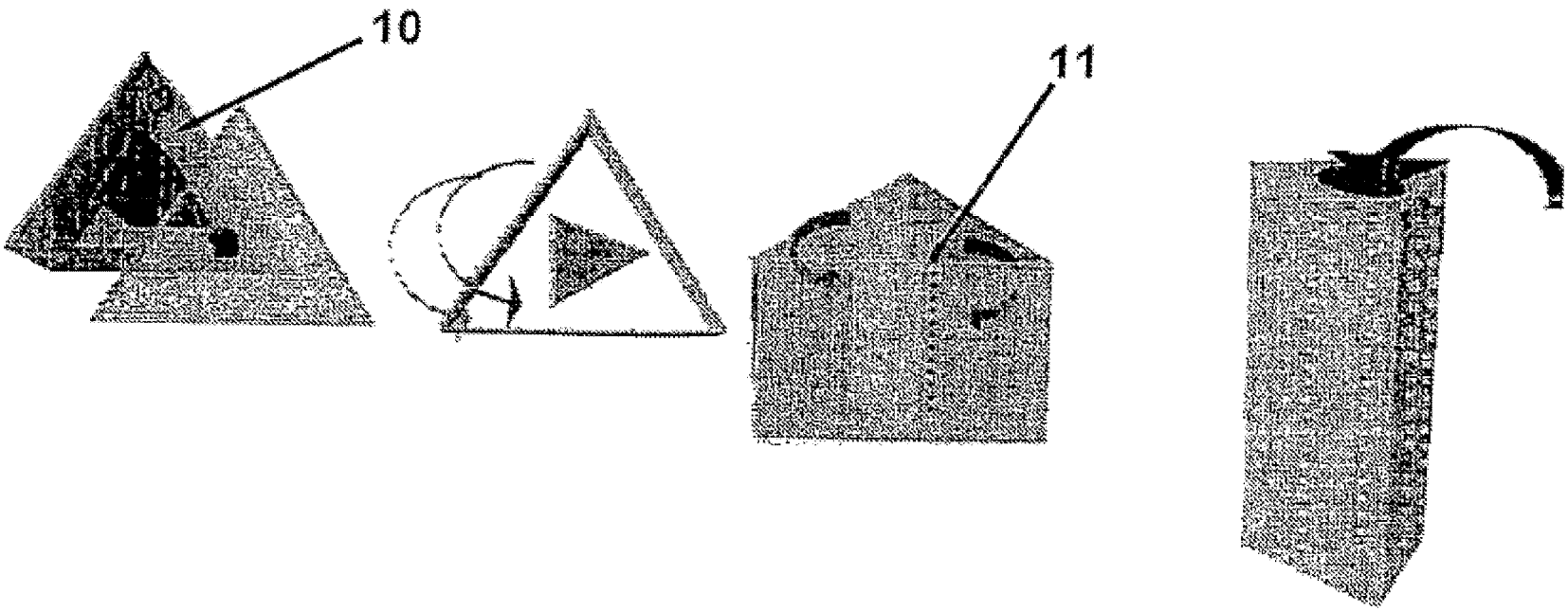
FIG. 4 shows a vertical in the shape of a prism.

In a fourth implementation, as shown in FIG. 4, the hollow equilateral triangles are built from vertical blinds 1, whereby inside the hollow spaces 10 a rotating light core 11 has been fixed, so that three different light-effects and images are possible.

The vertical blind system according to the invention can be hung also horizontally by using an adapted rail system, whereby the blinds can be rotating in the left and right side of that rail system.

The invention claimed is:

1. Vertical blind system for presenting information, which consists of:

a. a rail system;

b. hollow, light-permeable vertical blinds; and c. an internal light source characterized in that the light source in the hollow vertical blind consists of a large number of LEDS, or another light source assembled to a partition in the vertical blind, wherein every vertical blind has been bolted to the top and bottom side with a lock cap, and wherein the light source is fixed thereto.

2. The vertical blind system of claim 1, wherein the light-permeable vertical blind has been provided to the inside with one or two interchangeable sheets with images.

3. The vertical blind system, of claim 1, wherein the light sources in each vertical blind and lock cap is linked independently of each other.

4. The vertical blind system according to claim 3, wherein each vertical blind is formed of a massive, light translucent material.

5. The vertical blind system of claim 4, wherein the hollow and light-permeable vertical blinds consist of a hollow, equilateral triangle with a rotatable light core.

* * * * *